US008789244B2

(12) United States Patent
Vangheluwe et al.

(10) Patent No.: US 8,789,244 B2
(45) Date of Patent: Jul. 29, 2014

(54) WIRE PROFILE FOR CARD CLOTHING

(75) Inventors: Lieven Vangheluwe, Ronse (BE); Philip Furnier, Deerlijk (BE)

(73) Assignees: NV Bekaert SA, Zwevegem (BE); Bekaert Carding Solutions NV, Zwevegem (BE)

( * ) Notice: Subject to any disclaimer, the term of this patent is extended or adjusted under 35 U.S.C. 154(b) by 0 days.

(21) Appl. No.: 13/814,876

(22) PCT Filed: Jul. 11, 2011

(86) PCT No.: PCT/EP2011/061742
§ 371 (c)(1),
(2), (4) Date: Feb. 7, 2013

(87) PCT Pub. No.: WO2012/019841
PCT Pub. Date: Feb. 16, 2012

(65) Prior Publication Data

US 2013/0133159 A1 May 30, 2013

(30) Foreign Application Priority Data

Aug. 9, 2010 (EP) ..... 10172265

(51) Int. Cl.
*D01G 15/84* (2006.01)

(52) U.S. Cl.
USPC ..... 19/114

(58) Field of Classification Search
USPC ..... 19/114; 57/315, 327, 408, 412; D15/78
See application file for complete search history.

(56) References Cited

U.S. PATENT DOCUMENTS

| | | | | | |
|---|---|---|---|---|---|
| 2,937,413 | A * | 5/1960 | Hollingsworth | 19/114 |
| 4,268,937 | A * | 5/1981 | Grimshaw | 19/114 |
| 4,653,152 | A * | 3/1987 | Wada | 19/114 |
| 5,581,848 | A * | 12/1996 | Egerer | 19/114 |
| 6,185,789 | B1 * | 2/2001 | Hollingsworth et al. | 19/114 |
| 6,408,487 | B1 * | 6/2002 | Atkinson | 19/114 |
| 6,523,226 | B2 * | 2/2003 | Graf | 19/114 |
| 6,874,203 | B2 * | 4/2005 | Bauersachs | 19/114 |
| 6,920,671 | B2 * | 7/2005 | Graf | 19/114 |
| 2004/0128800 | A1 | 7/2004 | Graf | |
| 2004/0154137 | A1 | 8/2004 | Bauersachs | |
| 2012/0255143 | A1 * | 10/2012 | Iten et al. | 19/106 R |
| 2013/0042437 | A1 * | 2/2013 | Vangheluwe et al. | 19/114 |

FOREIGN PATENT DOCUMENTS

| | | | |
|---|---|---|---|
| DE | 41 17 715 | A1 | 12/1992 |
| EP | 1 408 142 | A1 | 4/2004 |
| FR | 2 821 863 | A1 | 9/2002 |
| GB | 2 157 330 | A | 10/1985 |
| WO | WO 02/077338 | A1 | 10/2002 |

* cited by examiner

*Primary Examiner* — Shaun R Hurley
(74) *Attorney, Agent, or Firm* — Foley & Lardner LLP

(57) ABSTRACT

A wire profile having a rib portion and plurality of teeth over the length of said rib portion, wherein said plurality of teeth is inclined at an angle with respect to the said rib portion, wherein said teeth has a front portion and a back portion, wherein said front portion is the inner portion of the said teeth leaning towards the rib portion and said back portion is the outer portion of the said teeth, and wherein at least one teeth with said back portion comprises at least one nose cut segment.

16 Claims, 2 Drawing Sheets

WIRE PROFILE FOR CARD CLOTHING

TECHNICAL FIELD

The invention relates to a wire profile for processing textile fibers using a carding machine, in particular, for condenser rollers condensing the fiber web. The wire profile of the present invention comprises a rib portion and plurality of teeth over the length of said rib portion.

BACKGROUND ART

Figure 1:
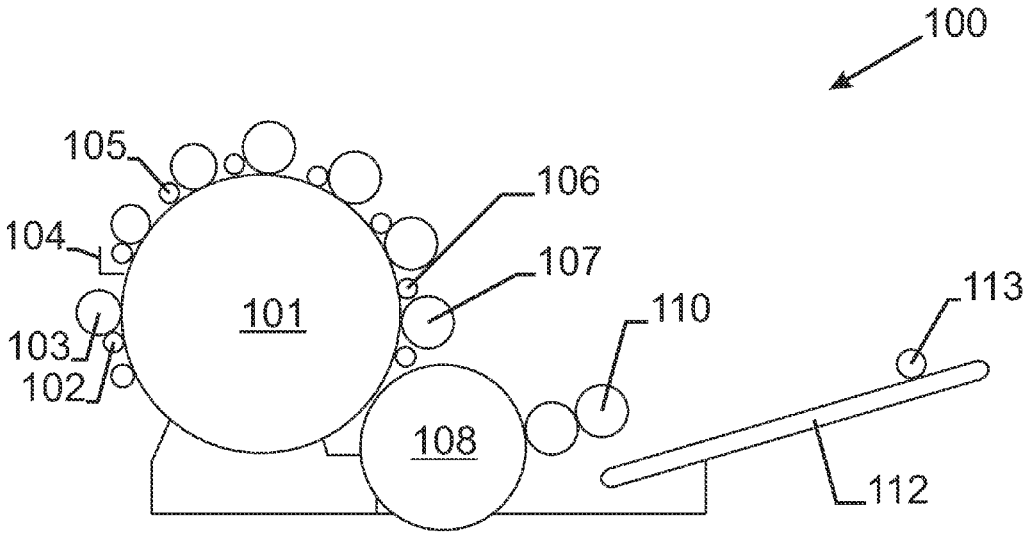

In modern carding devices, the fibers come in contact with a plurality of carding elements. The carding elements are rollers or flat or curved plates or segments, all covered with teeth. Each interaction between carding elements where fibers are separated and combed on the card is called a carding point. FIG. 1 illustrates one such example of a carding device. As an example of a carding point, the interaction between cylinder rollers and worker rollers (or workers) can be named. Typical for the carding interaction between cylinder and worker rollers; and between cylinder and doffer rollers is the partial transfer of fibers between the rollers that interact. After separating and combing the fibers at different carding points, the fibers need to be removed out of the carding machine by means of taking the fibers under the form of a web from the rollers. In order to modify fiber arrangement in the web when taking the fibers out of the card, "condenser rollers" (or condensers) can be used. The condensers are one or two rollers arranged after the doffer. These rollers condense the web coming from the doffer. FR 2821863 describes carding machine equipment, especially for doffers, workers or condensing cylinders, comprising radially-projecting teeth with attack and back surfaces. The backs of some of the teeth have notches to retain outward sliding fibers. WO 02/077338 describes a saw-tooth wire for a stripper roller for a roller card wherein the back angle of the individual teeth increases from the root to the tip of the tooth. In order to improve the delivery properties of the stripper roller to the subsequent stuffer roller, the tooth back is steep in the area of the tip, while the breast angle is large, thereby facilitating the take-over of fibers from the tambour that rotates at a higher speed.

By giving the condenser a lower speed than the previous roller, and by using higher wires with lower point densities, they collect more web per given surface area and condense the fiber into a heavier web. The diameter of the condenser rollers should be large enough in order to control the heavier web. Due to this condensing action, fibers are more vertically and more randomly orientated, compared to the strong orientation in production direction of the fibers on the doffer.

From experience it is known that the condenser rollers should not exceed a certain maximum speed for instance 200 m/min. Speed causes problems such as loosing fibers (fiber fly); selvages of the web which tend to form fringes or the web itself is torn and incomplete transfer of the web from the condenser roller to the next roller (loading) which requires that the carding machine is stopped from time to time to clean the loaded rollers. Thus these mentioned problems lead to impairment in production and product quality.

SUMMARY OF INVENTION

It is an object of at least certain embodiments of the present invention to devise a wire profile for card clothing, for instance a condenser roller that efficiently penetrates, captures and controls the synthetic and natural fibers during the carding process.

It is further object of at least certain embodiments of the present invention to devise a wire profile for card clothing, for instance a condenser roller that improves the efficient transfer of fiber from doffer to condenser rollers.

It is further object of at least certain embodiments of the present invention to devise a wire profile for card clothing, for instance a condenser roller that is wear resistant so that replacements of card clothing on the rollers and plates of the carding machines are less common thus saving time and maintenance costs.

It is further object of at least certain embodiments of the present invention to devise a wire profile for card clothing, for instance a condenser roller that creates fiber space so that increased volume of fibers can be retained in the card wire.

It is another object of the present invention to provide for a wire profile which imparts frictional resistance to the fiber during the carding process.

Thus, one aspect of the invention is a wire profile having a rib portion and plurality of teeth over the length of said rib portion, wherein said plurality of teeth is inclined at an angle with respect to the said rib portion, wherein said teeth has a front portion and a back portion, wherein said front portion is the inner portion of the said teeth leaning towards the rib portion and said back portion is the outer portion of the said teeth, and wherein at least one teeth with said back portion comprises at least one nose cut segment comprising a slope portion (L1) and a bottom portion (L2) connected by a curvature and the nose angle ($\alpha$) between slope portion (L1) and a bottom portion (L2) ranges from 20° to 75°.

Another aspect of the present invention is an condenser roller for a carding machine with a rotatable cylindrical body encompassed by a wire profile having a rib portion and plurality of teeth over the length of said rib portion, wherein said plurality of teeth is inclined at an angle with respect to the said rib portion, wherein said teeth has a front portion and a back portion, wherein said front portion is the inner portion of the said teeth leaning towards the rib portion and said back portion is the outer portion of the said teeth, and wherein at least one teeth with said back portion comprises at least one nose cut segment comprising a slope portion (L1) and a bottom portion (L2) connected by a curvature and the nose angle ($\alpha$) between slope portion (L1) and a bottom portion (L2) ranges from 20° to 75°.

The advantage of such a wire profile of the invention solves the problem relating to speed limitation of the condenser rollers, wherein the speeds can be increased with increase in fiber transfer efficiency from doffer to the condensing roller, thus resulting in a higher output of the carding machine.

In one aspect of the present invention, the wire profile has at least two nose cut segments. The advantage of such a wire profile of the invention is to further increase in fiber transfer efficiency between the doffer and the condenser roller. Thus transfer can be regular, meaning that all fibers are transferred at the same moment and avoiding a wave formation between the doffer and condenser roller. As a consequence, the final web will be more regular in appearance and in mass per area compared to a situation in which the wavy transfer between doffer and condenser roller exists.

In one aspect of the present invention, the tip of nose cut segment of wire profile is rounded forming a nose radius and said nose radius can range from 0.1 mm to 0.4 mm. The advantage of such a wire profile of the invention is to increase wear resistance.

Thus, another aspect of the invention is a method of manufacturing wire profile of the present invention by a process comprising the steps of: (i) feeding wire by means of continuous feeding mechanism; and (ii) performing a slicing procedure using a blade, wherein said blade is set to pass through a shaped die.

BRIEF DESCRIPTION OF FIGURES IN THE DRAWINGS

FIG. 1 illustrates different elements of a carding device 100. A typical carding device comprises a main cylinder 101, stripper roller 102, working roller 103, impurities removing device 104, stripping roller 105, fancy stripping roller 106, fancy roller 107, doffer 108, condensing rollers 110, conveyer 112 and pressing roller 113.

Figure 2:
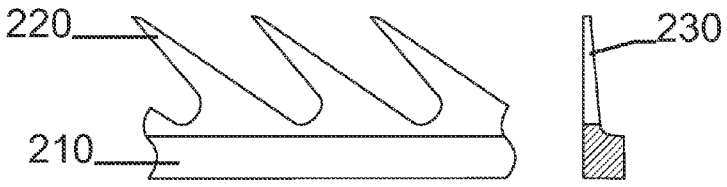
Prior Art Fig. 2

FIG. 2 shows wire profile for condenser roller according to prior art. The wire profile comprises a rib portion 210 and plurality of teeth 220. Axial cross section of wire profile is also shown 230.

Figure 3:
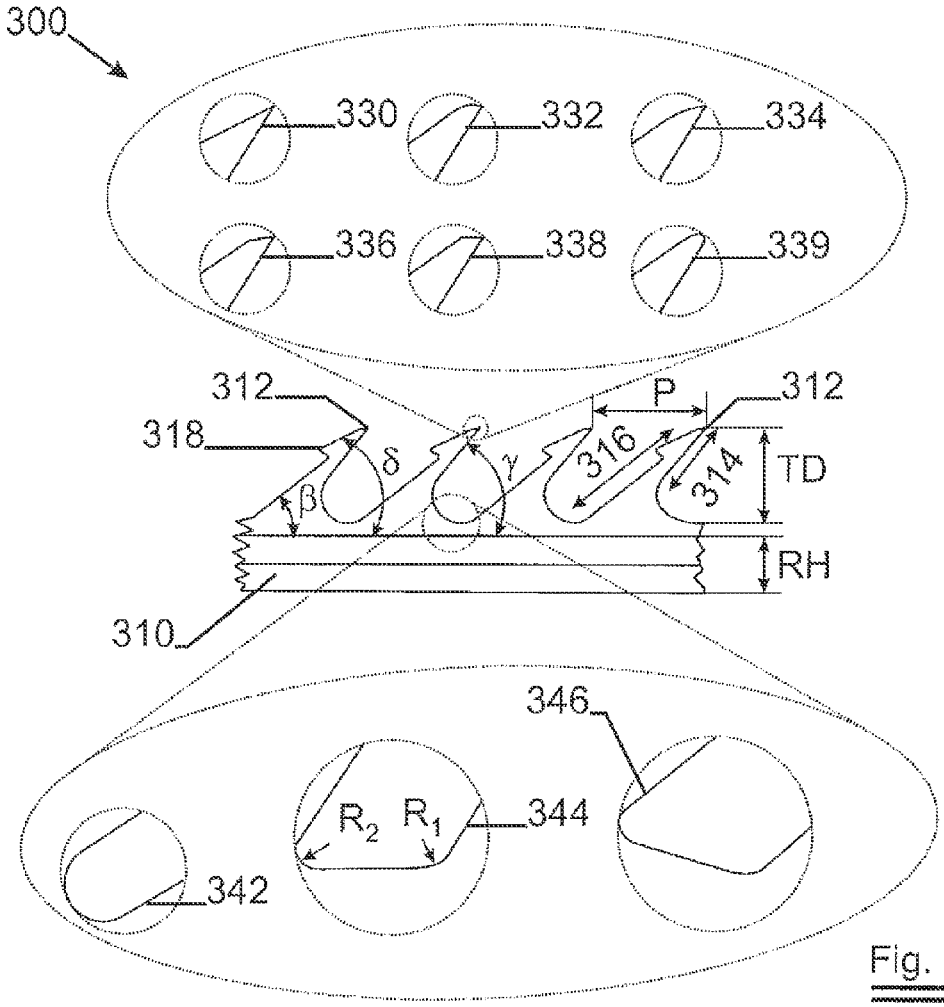
Figure 4:
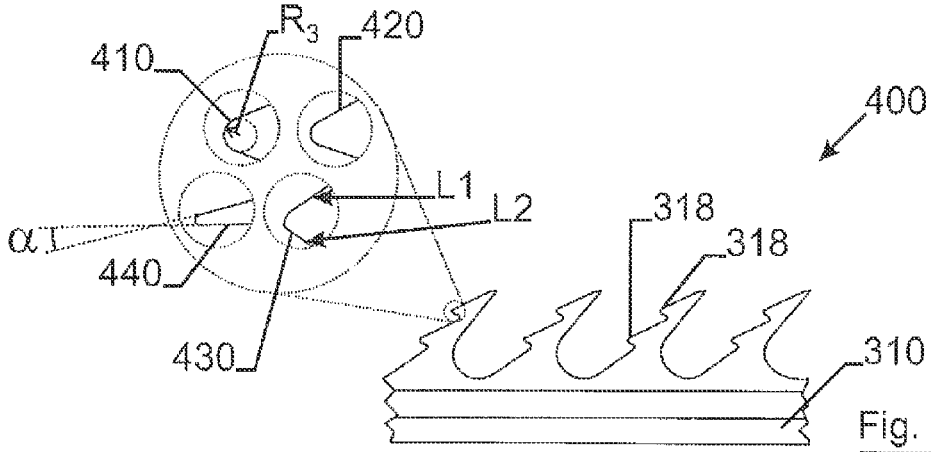

FIGS. 3 and 4 shows different embodiments of wire profile in lateral view according to the invention.

DEFINITIONS

The term "front angle" refers to the angle γ between the front portion 314 of the teeth and the rib portion 310. The front angle γ may range from 30° to 70°. In a preferred embodiment the angle is 55°. In another preferred embodiment the angle is 55°.

The term "back base angle" refers to the angle β between the base portion (below the nose cut segment) of the back portion 316 of the teeth, and the rib portion 310. The back angle β may range from 25° to 65°. In preferred embodiment the back angle is 41°.

The term "back top angle" refers to the angle δ between the top portion (slope portion of the nose cut segment L1) of the back portion 316 of the teeth, and the rib portion 310. The back angle δ may range from 25° to 65°. In preferred embodiment the δ is 25°.

The term "tooth pitch" P is the longitudinal distance between a pair of adjacent teeth 312 on the wire profile. The tooth pitch may range between 1.50 mm to 8.00 mm. In one embodiment of the present invention the tooth pitch is 3.60 mm.

The term "tooth depth" TD refers to the depth of the tooth. The tooth depth may range between 2.00 mm to 5.00 mm. In one embodiment of the present invention the tooth depth is 3.30 mm. In another embodiment the tooth depth is 3.05 mm.

The term "rib height" RH refers to the width of the rib portion. The rib height may range between 1.0 mm to 2.20 mm. In one embodiment of the present invention the rib height is 1.80 mm. In another embodiment of the invention, the rib height is 1.40 mm.

The term "striations" refers to a number of tiny parallel grooves/veins along the longitudinal direction of the wire profile. In one embodiment of the present invention the teeth of the wire profile comprises striations along the longitudinal direction of the said wire profile. In another embodiment of the present invention the striations are positioned along the said nose cut segment.

The term "spaced segment" refers to the spacing between a pair of teeth and in particular the segment refers to the base portion of said teeth wherein the front slope of one teeth and back slope of adjacent teeth converges towards the rib portion. FIG. 3 also depicts different spaced segments of the present invention. In one embodiment of the present invention, the distance between the points of confluence of back slope to the rib portion of first teeth to the point of confluence of front slope to the rib portion of second consecutive teeth is defined as the "spaced segment". In one embodiment of the present invention the spaced segment is radial curved 342. In yet another embodiment of the present invention the spaced segment is radial curved at the points of confluence R1, R2 and portion between the said points of confluence is flat bottom 344. In yet another embodiment of the present invention the spaced segment is radial curved at the points of confluence and portion between the said points of confluence is inclined at an acute angle with respect to the rib portion 346.

The term "nose cut segment" refers to the specific design on part of the back portion of at least one teeth and said design comprises a slope portion (L1) and bottom portion (L2) which follows the contour of a nose. The back portion of at least one teeth of the wire profile of the present invention may contain one, two or three nose cut segments. In one embodiment of the present invention, the back portion of at least one teeth contains one nose cut segment.

The term "tip of nose segment" as seen in planar view is made up of two straight or curvature meeting at a point, for instance tip of nose segment is defined as the point of confluence of L1 (slope portion of the nose cut segment) and L2 (bottom portion of the nose cut segment) the said point for instance can be modified by rounding to a relatively small nose radius $R_3$ in the point region 410. The nose radius $R_3$ for instance can range from 0.1 to 0.4 mm. In one embodiment of the present invention the nose radius $R_3$ is 0.15 mm.

The term "nose angle" is an angle made between the two straight lines L1 (slope portion of the nose cut segment) and L2 (bottom portion of the nose cut segment) is referred to as nose angle α. In case the two straight lines L1 and L2 is connected by a curvature as shown for instance in 410, 420, 430, 440 then L1 and L2 may represent as a tangent to the curvature and the angle between the meeting point of the two tangents is referred to as nose angle α. In one embodiment of the present invention, the nose angle α ranges from 20° to 75°, preferably 30° to 60° more preferably 37° to 58°, most preferably 40° to 50°.

DETAILED DESCRIPTION OF THE INVENTION

FIG. 3 illustrates the wire profile 300 of the present invention having a rib portion 310 and plurality of teeth 312 over the length of said rib portion, wherein said plurality of teeth is inclined at an angle with respect to the said rib portion, wherein said teeth has a front portion 314 and a back portion 316, wherein said front portion is the inner portion of the said teeth leaning towards the rib portion and said back portion is the outer portion of the said teeth, and wherein at least one teeth with said back portion comprises at least one nose cut segment 318. The angle of inclination of teeth with respect to the rib portion of the wire profile of the present invention may refer to the front angle, the back base angle, the back top angle and combinations thereof. In one embodiment, the wire profile of the present invention is used for a condenser roller.

In one embodiment, the wire profile of the present invention has a rib portion and plurality of teeth over the length of said rib portion, wherein said plurality of teeth is inclined at an angle with respect to the said rib portion, wherein said teeth has a front portion and a back portion, wherein said front portion is the inner portion of the said teeth leaning towards the rib portion and said back portion is the outer portion of the said teeth, and wherein at least one teeth with said back portion comprises at least one nose cut segment and wherein said angle refers to the front angle, the back base angle and the back top angle, and wherein said front angle is 55°, and wherein said back base angle is 41°, and wherein said back top angle is 25°.

FIG. 3 also depicts different shapes of the tip for the teeth of the present invention. In one embodiment of the present invention the shape of the tip is cut point 330. In another embodiment of the present invention the shape of the tip is semi aquiline 332. In yet another embodiment of the present invention the shape of the tip is full aquiline 334. In yet another embodiment of the present invention the shape of the tip is double back angle 336. In yet another embodiment of the present invention the shape of the tip is flat land 338. In yet another embodiment of the present invention the shape of the tip is rounded 339.

In one embodiment of the present invention the shape of the rib is rectangular to form a wedge shaped card wire. In another embodiment of the present invention the shape of the rib is v-interlocking. In yet another embodiment of the present invention the shape of the rib is rectangular to form an L-shaped wire.

FIG. 4 illustrates the wire profile 400 of the present invention having two nose cut segments consecutive to one another.

A wire profile of the present invention can be made as follows. Starting product is a wire rod (usual diameters 1.20 mm or 7.0 mm) with a steel composition along the following lines:

carbon content ranging from 0.30% to 2.0%, e.g. from 0.5 to 1.2%; e.g. from 0.6 to 1.1%;

silicon content ranging from 0.10% to 2.5%, e.g. from 0.15 to 1.60%;

manganese content ranging from 0.10% to 2.0%, e.g. from 0.50 to 0.90%;

chromium content ranging from 0.0% to 2.0%, e.g. from 0.10% to 1.50%; e.g. from 0.10% to 0.90%;

vanadium content ranging from 0.0% to 2.0%, e.g. from 0.05% to 0.60%, e.g. from 0.10% to 0.50%;

tungsten content ranging from 0.0% to 1.5%, e.g. from 0.1% to 0.70%.

In one embodiment of the present invention, the composition of wire profile may contain either chromium or vanadium. In some other compositions both chromium and vanadium are present. The amounts of sulfur and phosphorous are preferably kept as low as possible, e.g. both below 0.05%, e.g. below 0.025%.

The wire rod is cold and dry drawn until the desired non-round profile is reached. Rolling can be carried out by means of Turks heads or by means of rolls. Drawing can be done by means of profile drawing dies. The profile depends upon the application can be square, rectangular, or take an L-form. The basis leg of the L forms the rib portion and the top leg of the L will house the eventual teeth. After this profiling, the teeth are formed in the profile wire by means of a cutting operation preferably a punching operation. The forming of the teeth may be followed by an operation that cleans the wire surface.

Thereafter the formed saw toothed wire profile is subjected to some heat treatments, which aim at stress-relieving the rib portion of the saw-toothed wire and at hardening the teeth. Therefore, the entire saw toothed wire is heated until a temperature in the neighborhood of 600° C. and the teeth get an additional heating until they reach a temperature of about 900° C. Thereafter the entire wire is quenched so that the foot is stress relieved and the teeth are hardened since the teeth are subjected to a much greater jump in temperature. The global heating until 600° C. can be done by means of induction heating or by means of a gas burner. The heating of the teeth until 900° C. can be done by means of an additional gas burner, or by passing the teeth through a plasma arc or torch. The quenching operation can be done in an oil bath or in a bath of polymers. The heat treatment of the wire may be followed by an operation that cleans the wire surface.

The performance of the card wire of the present invention can be verified via the visual observation of the web regularity and of the number of neps present in the web. For specific nonwoven fabrics made with the carded web, specific application related experiments can be performed for comparison of carded webs. Examples are tensile strength in machine direction (MD) and cross direction (CD) and its ratio. For filtration fabrics, filtration parameters (e.g. strike through, filtration performance . . . ) are strongly related to product regularity.

Any reference signs do not limit the scope of the claims.

The invention claimed is:

1. A wire profile having a rib portion and a plurality of teeth over the length of said rib portion, wherein said plurality of teeth is inclined at an angle with respect to said rib portion, wherein said teeth have a front portion and a back portion, wherein said front portion is an inner portion of said teeth leaning towards the rib portion, and said back portion is an outer portion of said teeth, wherein at least one of the teeth with said back portion comprises at least one nose cut segment, wherein said nose cut segment comprises a slope portion and a bottom portion connected by a curvature, and a nose angle between the slope portion and the bottom portion ranges from 20° to 75°;

wherein a tip of said nose cut segment is rounded such that the tip forms a nose radius, and wherein said nose radius is configured to range from 0.1 to 0.4 mm.

2. The wire profile of claim 1, wherein said back portion comprises two nose cut segments disposed consecutively to one another.

3. The wire profile of claim 1, wherein the nose angle of said nose cut segment ranges from 30° to 60°.

4. The wire profile of claim 3, wherein said nose angle ranges from 30° to 55°.

5. The wire profile of claim 1, wherein said angle with respect to said rib portion is a front angle and said front angle ranges from 30° to 70°.

6. The wire profile of claim 1, wherein said angle with respect to said rib portion is a back base angle, and said back base angle ranges from 25° to 65°.

7. The wire profile of claim 1, wherein said angle with respect to said rib portion is a back top angle and said back top angle ranges from 25° to 65°.

8. The wire profile of claim 1, wherein the shape of a tooth tip is cut point.

9. The wire profile of claim 1, wherein the shape of a tooth tip is semi aquiline.

10. The wire profile of claim 1, wherein the shape of a tooth tip is full aquiline.

11. The wire profile of claim 1, wherein the shape of a tooth tip is double back angle.

12. The wire profile of claim 1, wherein the shape of a tooth tip is flat land.

13. The wire profile of claim 1, wherein the shape of a tooth tip is rounded.

14. The wire profile of claim 1, wherein said teeth further comprise striations along the longitudinal direction of said wire profile.

15. The wire profile of claim 14, wherein said striations are positioned along said nose cut segment.

16. A condenser roller for a carding machine with a rotatable cylindrical body encompassed by the wire profile of claim 1.

* * * * *